US007264278B2

(12) United States Patent
Fox-Lovell

(10) Patent No.: US 7,264,278 B2
(45) Date of Patent: Sep. 4, 2007

(54) CUSTOMER REGISTRATION SYSTEM AND CORRESPONDING METHOD OF USE

(75) Inventor: Sheila D. Fox-Lovell, Marietta, GA (US)

(73) Assignee: Shandy Graphics, Inc., Marietta, GA (US)

( * ) Notice: Subject to any disclaimer, the term of this patent is extended or adjusted under 35 U.S.C. 154(b) by 1214 days.

(21) Appl. No.: 09/817,826

(22) Filed: Mar. 26, 2001

(65) Prior Publication Data

US 2002/0020488 A1 Feb. 21, 2002

Related U.S. Application Data

(60) Provisional application No. 60/201,484, filed on May 3, 2000.

(51) Int. Cl.
*B42D 15/00* (2006.01)

(52) U.S. Cl. ..... 283/81; 281/15.1; 283/101

(58) Field of Classification Search ..... 283/67, 283/81, 70, 94, 98, 101, 105, 900, 61, 62, 283/63.1; 281/3.1, 2, 5, 15.1, 21.1; 402/57, 402/73, 79; 156/249; 705/3, 5
See application file for complete search history.

(56) References Cited

U.S. PATENT DOCUMENTS 4,159,129 A * 6/1979 Lockhart ..... 462/67
4,190,268 A * 2/1980 Webster ..... 462/66
4,865,549 A * 9/1989 Sonsteby ..... 434/262
4,907,904 A * 3/1990 Baldwin ..... 402/80 R
4,971,364 A * 11/1990 Templet ..... 283/70
4,976,351 A * 12/1990 Mangini et al. ..... 206/232
5,026,196 A * 6/1991 Brass ..... 402/79
5,048,870 A * 9/1991 Mangini et al. ..... 283/81
5,143,466 A * 9/1992 Moncrieff
Baldwin et al. ..... 402/79
5,531,482 A * 7/1996 Blank ..... 283/67
5,795,090 A * 8/1998 Jackson ..... 402/79
6,086,108 A * 7/2000 Rosenberger ..... 283/81
6,135,507 A * 10/2000 Hamby et al. ..... 283/81
6,155,603 A * 12/2000 Fox ..... 283/62
6,161,870 A * 12/2000 Blank ..... 283/75

* cited by examiner

*Primary Examiner*—Monica Carter
(74) *Attorney, Agent, or Firm*—Gary Robinson, P.A.

(57) ABSTRACT

The system includes a registration log and a sequence of registration labels (101-120) detachably secured to a first substrate (100). Each label has indicia (122) that identifies to the position of the label in the sequence and includes space in which the customer is to enter information. The log includes substrates (300), having a plurality of label-retaining spaces (301-320). Each space (301-320) includes indicia (324) that identifies the position of the space in the sequence of spaces and corresponds to a respective indicia (122) of a registration label. After a customer enters information manually on a registration label, the system user detaches the label from the substrate (100) and attaches it to a corresponding space in the registration log. The log is kept out of view of other customers to maintain confidentiality of customer information.

11 Claims, 6 Drawing Sheets

FIG. 1

100

| | | | | | |
|---|---|---|---|---|---|
| 101 | (1) 122 NAME ____ ARRIVAL TIME ____ ADDRESS CHANGE? ☐ PHYSICIAN ____ INSURANCE CHANGE? ☐ | | (11) NAME ____ ARRIVAL TIME ____ ADDRESS CHANGE? ☐ PHYSICIAN ____ INSURANCE CHANGE? ☐ | 111 |
| 102 | (2) NAME ____ ARRIVAL TIME ____ ADDRESS CHANGE? ☐ PHYSICIAN ____ INSURANCE CHANGE? ☐ | | (12) NAME ____ ARRIVAL TIME ____ ADDRESS CHANGE? ☐ PHYSICIAN ____ INSURANCE CHANGE? ☐ | 112 |
| 103 | (3) NAME ____ ARRIVAL TIME ____ ADDRESS CHANGE? ☐ PHYSICIAN ____ INSURANCE CHANGE? ☐ | | (13) NAME ____ ARRIVAL TIME ____ ADDRESS CHANGE? ☐ PHYSICIAN ____ INSURANCE CHANGE? ☐ | 113 |
| 104 | (4) NAME ____ ARRIVAL TIME ____ ADDRESS CHANGE? ☐ PHYSICIAN ____ INSURANCE CHANGE? ☐ | | (14) NAME ____ ARRIVAL TIME ____ ADDRESS CHANGE? ☐ PHYSICIAN ____ INSURANCE CHANGE? ☐ | 114 |
| 105 | (5) NAME ____ ARRIVAL TIME ____ ADDRESS CHANGE? ☐ PHYSICIAN ____ INSURANCE CHANGE? ☐ | | (15) NAME ____ ARRIVAL TIME ____ ADDRESS CHANGE? ☐ PHYSICIAN ____ INSURANCE CHANGE? ☐ | 115 |
| 106 | (6) NAME ____ ARRIVAL TIME ____ ADDRESS CHANGE? ☐ PHYSICIAN ____ INSURANCE CHANGE? ☐ | | (16) NAME ____ ARRIVAL TIME ____ ADDRESS CHANGE? ☐ PHYSICIAN ____ INSURANCE CHANGE? ☐ | 116 |
| 107 | (7) NAME ____ ARRIVAL TIME ____ ADDRESS CHANGE? ☐ PHYSICIAN ____ INSURANCE CHANGE? ☐ | | (17) NAME ____ ARRIVAL TIME ____ ADDRESS CHANGE? ☐ PHYSICIAN ____ INSURANCE CHANGE? ☐ | 117 |
| 108 | (8) NAME ____ ARRIVAL TIME ____ ADDRESS CHANGE? ☐ PHYSICIAN ____ INSURANCE CHANGE? ☐ | | (18) NAME ____ ARRIVAL TIME ____ ADDRESS CHANGE? ☐ PHYSICIAN ____ INSURANCE CHANGE? ☐ | 118 |
| 109 | (9) NAME ____ ARRIVAL TIME ____ ADDRESS CHANGE? ☐ PHYSICIAN ____ INSURANCE CHANGE? ☐ | | (19) NAME ____ ARRIVAL TIME ____ ADDRESS CHANGE? ☐ PHYSICIAN ____ INSURANCE CHANGE? ☐ | 119 |
| 110 | (10) NAME ____ ARRIVAL TIME ____ ADDRESS CHANGE? ☐ PHYSICIAN ____ INSURANCE CHANGE? ☐ | | (20) NAME ____ ARRIVAL TIME ____ ADDRESS CHANGE? ☐ PHYSICIAN ____ INSURANCE CHANGE? ☐ | 120 |

200

LOG BOOK

CONFIDENTIAL SIGN-IN SYSTEM

PRACTICE NAME: _____

_____

DATE FROM: _____

DATE TO: _____

FIG. 2A

INSTRUCTIONS FOR USING THE CONFIDENTIAL SIGN-IN SYSTEM

201 WRITE DATE IN UPPER CORNER OF THE PAGE BEING USED IN THE "PATIENT SIGN-IN LOG".

202 PLACE A SHEET OF "PATIENT SIGN-IN LABELS" ON CLIPBOARD AND PUT AT FRONT DESK, OR WHEREVER A SIGN-IN SHEET HAS BEEN PUT IN THE PAST.

203 PEEL LABELS FROM THE SHEET IMMEDIATELY AFTER EACH PATIENT SIGNS IN, AND TRANSFER TO THE "PATIENT SIGN-IN LOG". (BE SURE TO NOTE THAT THERE ARE NUMBERS ON BOTH THE LABELS AND THE SPACES ON THE LOG. THE LABEL NUMBERED 1 SHOULD BE PLACED IN THE SPACE NUMBERED 1, AND SO ON DOWN THE PAGE.)

204 MORE THAN ONE PAGE CAN BE USED FOR ANY ONE DAY. ALWAYS FILL OUT THE DATE AT THE TOP OF THE LOG SHEET.

205 IF A LABEL NEEDS TO BE REWRITTEN, WRITE "VOID" IN THE LOG IN THE APPROPRIATE SPACE, OR WRITE "VOID" ON THE LABEL AND TRANSFER TO THE CORRESPONDING SPACE IN THE LOGBOOK.

---

RECOMMENDED PROCEEDURE

206 IF LABELS ARE LEFT ON THE SHEET AT THE END OF THE DAY, IT IS IMPORTANT THAT THE SHEET OF REMAINING LABELS BE DESTROYED. USE A NEW SHEET OF LABELS FOR EVERY NEW DAY.

207 ALWAYS USE A NEW PAGE IN THE LOG FOR A NEW DAY AND START A NEW SHEET OF LABELS FOR EACH NEW DAY. THIS WILL ALLOW FOR ACCURATE ACCOUNTING OF THE NUMBER OF PATIENTS SEEN ON ANY PARTICULAR DAY.

OR

208 ALTERNATE METHOD #1

DO NOT DESTROY REMAINING LABELS AT END OF DAY. START NEXT DAY WHERE YOU STOPPED THE DAY BEFORE, STAYING IN SEQUENCE. MAKE A MARK IN THE LOGBOOK TO INDICATE THE END OF ONE DAY AND THE START OF THE NEW DAY, NOTING THE NEW DATE IN THE MARGIN. (I.E. IF THERE ARE ONLY 12 PATIENTS ONE DAY, YOU CAN START THE NEXT DAY USING LABEL #13, IN SPACE #13, MAKING A NOTICEABLE MARK TO INDICATE THE START OF THE NEXT DAY.)

OR

209 ALTERNATE METHOD #2

DO NOT DESTROY REMAINING LABELS AT END OF DAY. START NEXT DAY ON A NEW PAGE IN THE LOGBOOK, INDICATING THE NEW DATE IN THE SPACE PROVIDED, BUT PUT LABEL IN THE APPROPRIATELY NUMBERED SPACE (I.E. LABEL #13 GOES IN SPACE #13, JUST ON A NEW LOG PAGE).

FIG. 2B

CUSTOMER REGISTRATION SYSTEM AND CORRESPONDING METHOD OF USE

Priority under 35 U.S.C. § 119 (e) is hereby claimed to commonly assigned U.S. Provisional Application Ser. No. 60/201,484, filed May 3, 2000, which is expressly incorporated herein by reference in its entirety to form a part of the present disclosure.

FIELD OF THE INVENTION

The invention relates generally to systems and methods for registering customers at locations where services are provided to a customer. More particularly, the present invention relates to a customer registration system and corresponding method of use that provide confidentiality of information provided by the customer at the time of registration.

BACKGROUND OF THE INVENTION

Service providers, in particular health care providers, typically require their patients, clients or customers (collectively referred to herein and in the appended claims as "customers") to "sign in" or register upon their arrival at the facility in which the particular services are to be provided. Such registration is most prevalent at health care facilities, such as medical clinics, hospitals, laboratories, medical offices, dental offices, psychiatrist offices, psychologist offices, chiropractic offices, physical therapy offices, or any other location or facility at which medical-related services are provided.

Typically, medical service providers provide their patients a simple sign-in or registration sheet. When a patient comes into a medical office, he or she goes to the front desk to "sign in" or register. The sign-in sheet is usually on a clipboard and has between fifteen (15) and twenty-five (25) spaces. The sign-in procedure has several purposes other than merely informing the service provider that a patient has arrived to see a doctor. Some providers use the sign-in sheet as a control sheet for the billing process. In such a case, the service provider personnel will write down the superbill number next to the patient name so the service provider can account for all the billing for a particular day.

The sign-in sheet is also used for tracking information, such as how many patients the service provider(s) may see a day, how many patients are there to see a particular doctor, nurse or nurse practitioner, and how much lab work is being performed. Sometimes, in the case of very common names, the sign-in sheet is used to prove which "Mary Smith" checked in on a particular day.

In a typical sign-in procedure, the patient is asked to write down his or her name, the physicians' name, and sometimes an address, a phone number, an insurance company and/or other personal information. The problem with the typical sign-in sheet is that the patient, as he or she signs in, can see all the names and other pertinent information of the patients that have been there earlier in the day. Patients coming in later the same day can see the names of those patients that have come and gone, along with all other information which might have been requested and supplied. In many prior art sign-in approaches, the receptionist will take the sign-in sheet and highlight the name of the patients as they are taken back to see the doctor. However, other patients still have the ability to read an earlier patient's name right through the highlighting, together with any other information provided on the sheet by the earlier patient.

In the past two years, we have been asked to come up with some alternatives to the sign-in sheet described above. For one customer, the idea they liked best was a simple five inch by seven inch (12.7 cm by 17.8 cm) pad that stays at the front desk. When the patient comes in, they write their name, date of birth, and any other information on a single sheet of the pad and give the sheet to the front desk receptionist. The front office staff person then puts the sheet into a simple time clock for posting arrival time. The patient chart is then pulled and put into a queue for the nurse to take the patient to the examination room. The sheets are then batched and saved in stacks for future reference, if necessary. The problem with this approach is its necessity for additional hardware (i.e., a time clock).

For another customer, a two-part carbonless form was designed. The patient signs in on the multi-lined sheet, but instead of the patient's name being highlighted as described above, a thick black marker was used to cross their name off after their chart was pulled and they were taken to an examination room. Once the sheet is full, part one is thrown away and part two is maintained as the permanent document for future reference, if necessary. Although this approach significantly improves the confidentiality of patient-provided information as compared to prior art highlighting approaches, it requires patients to press hard when entering their information, a task that may be difficult for elderly or handicapped patients, and does not permit the retention of original patient handwriting.

Therefore, a need exists for a customer registration system and corresponding method of use that maintain the confidentiality of information provided by the customer at the time of registration, that facilitate retention of original customer handwriting, and that facilitate registration by all customers, without requiring additional hardware.

BRIEF DESCRIPTION OF THE DRAWINGS

FIG. 1 illustrates an exemplary substrate that includes a plurality of registration labels in accordance with a preferred embodiment of the present invention.

FIGS. 2A and 2B illustrate the front and back surfaces, respectively, of a front cover of a registration log in accordance with a preferred embodiment of the present invention.

DETAILED DESCRIPTION OF A PREFERRED EMBODIMENT

Figure 3A:
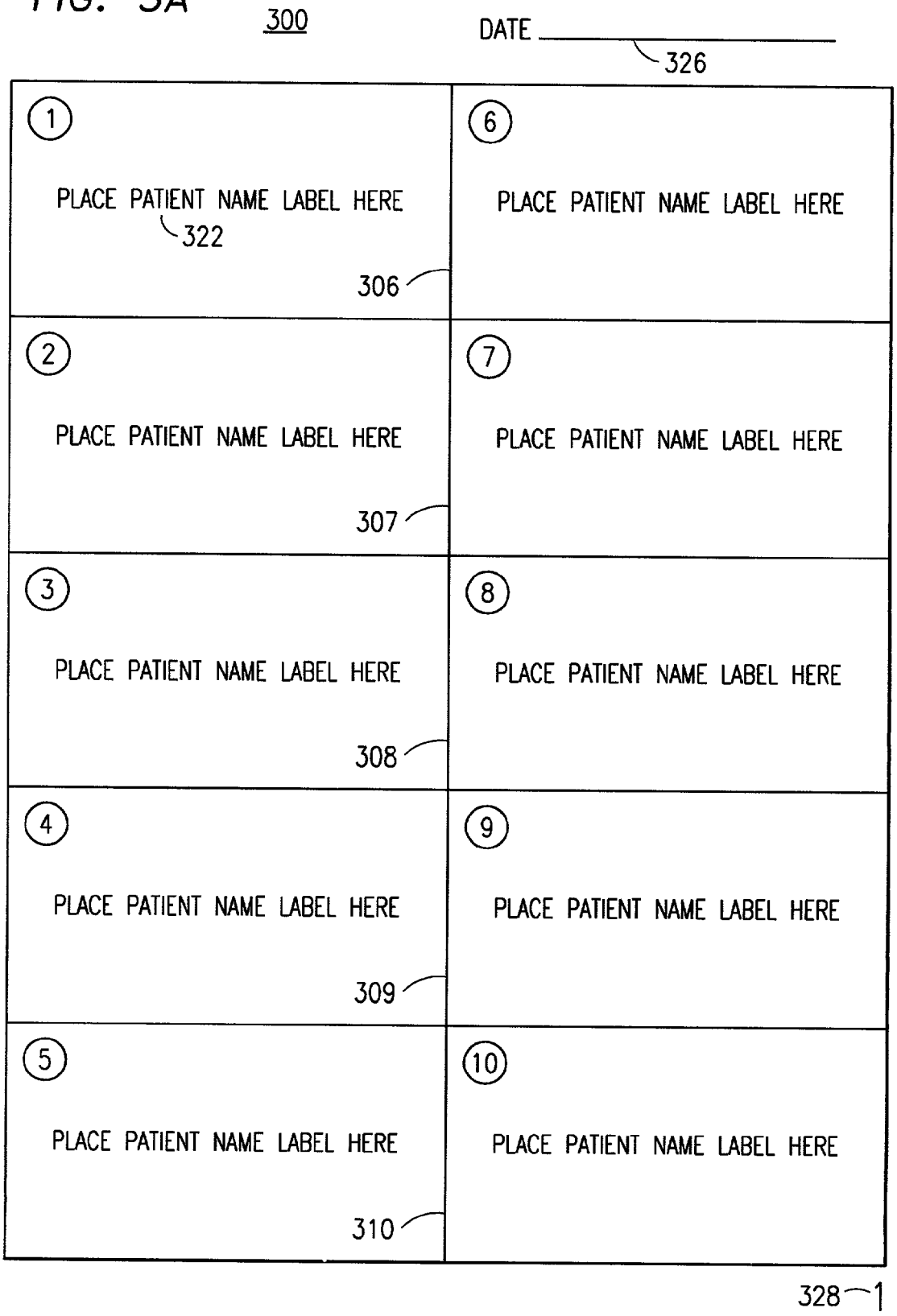
FIGS. 3A and 3B illustrate exemplary label-retaining spaces arranged on the front and back surfaces of a page of a registration log in accordance with a preferred embodiment of the present invention.

Generally, the present invention comprises a customer registration system and corresponding method of use. The customer registration system includes a plurality of registration labels and a registration log. The registration labels are arranged sequentially on and are detachable from a first substrate, such as conventional laser label stock or other conventional release-backing paper stock. Each of the registration labels includes a unique indicia that corresponds to a position of the label in the sequential arrangement of labels. For example, each label may be numbered in a corner of the label. Each label further includes at least one field having adequate area for the customer to enter his or her information (e.g., name, doctor, insurance carrier, and so forth) on the registration label.

The registration log includes one or more substrates (e.g., sheets of paper), wherein each substrate includes a plurality of label-retaining spaces arranged sequentially thereon. Each label-retaining space includes a unique indicia that corresponds to a position of the label-retaining space in the sequential arrangement of spaces and further corresponds to a respective unique indicia of a registration label. For example, in the event that the carrier sheet of labels includes twenty labels, each numbered from 1-20, each label-retaining space on a respective substrate is also numbered from 1-20 to provide a one-to-one correspondence with the registration labels. Each label-retaining space further includes adequate area for attaching a registration label to the label-retaining space after entry of information on the label by the customer.

When a customer enters the service premises, the customer enters his or her information manually on a registration label. Shortly after the entry of such information, the system user (e.g., service provider or associated office staff) detaches the registration label from the substrate and attaches the registration label to a corresponding label-retaining space in the registration log. The log is maintained inconspicuously relative to other customers to thereby maintain confidentiality of the registering customer's information. By registering customers in accordance with the present invention, the information provided by customers at the time of registration remains visible by other customers for a shorter period of time than with prior art "sign-in" or registration techniques, thereby resulting in improved confidentiality of the customer's information as compared to prior art techniques. In addition, the registration log contains original handwriting of the customers as opposed to carbon copies of such handwriting as in some prior art registration techniques.

The present invention can be more fully understood with reference to FIGS. 1-4. The system and method of the present invention are described herein primarily with respect to their use in a health care facility for registering patients substantially at the time of health care services, but such system and method are equally applicable for use by any service provider to register its customers substantially at the time that the particular services are to be provided, while substantially maintaining the confidentiality of information provided by the customers at the time of registration.

The patient registration or "sign-in" system of the present invention preferably includes two complimentary items: patient sign-in labels and a registration log. FIG. 1 illustrates an exemplary substrate 100 that includes a plurality of registration labels 101-120 in accordance with a preferred embodiment of the present invention. As depicted in FIG. 1, there is preferably one set of twenty (20) labels 101-120 to each standard 8.5 inch wide by 11 inch long (approximately 21.6 centimeter (cm) wide by 27.9 cm long) substrate 100 or carrier sheet. As noted above, each label 101-120 preferably includes adequate area for the customer to enter information thereon. In the preferred embodiment shown in FIG. 1, each label 101-120 is preferably provided such an area in the form of a field 124 printed with designated spaces for the patient's name, the name of the patient's physician, and the patient's time of arrival, and further includes two check boxes. One check box is to be checked if the patient has changed his or her address and the other check box is to be checked if the patient has changed insurance. In addition, each label 101-120 preferably includes a unique indicia 122, such as a numeral, letter of the alphabet, an alpha-numeric combination, or any other indicia, in the upper left-hand corner of the label 101-120. Based on the indicia 122, the labels 101-120 are preferably arranged sequentially in two columns, with labels 101-110 being arranged from top to bottom of the left-hand column and labels 111-120 being arranged from top to bottom of the right-hand column as shown in FIG. 1. The indicia 122 preferably provides an unique identification of each label 101-120 in a particular set of labels (e.g., set of Each label 101-120 preferably measures 1 inch by 3.5 inches (approximately 2.5 cm×8.9 cm). The labels 101-120 are preferably in two columns of ten labels each, as shown, with square corners that are "butt cut" (which means that the labels 101-120 butt up to each other on the top, bottom and sides). The label size and geometric shape were selected because they correspond to a standard size tooling die available at several label manufacturers. However, the size and geometric shape of each label may be selected at the option of the service provider to insure there is adequate area on the label 101-120 for the patient or customer to enter the information desired by the service provider. Non-standard size and shape labels may introduce additional expense and/or require the purchase of a custom tooling die. Each label 101-120 also preferably includes a "picture frame" margin on the outside border of the label 101-120 for ease in detaching the label 101-120 or peeling the label 101-120 off the sheet 100.

One consideration in the selection of the size of the label 101-120 is the intended customer. For example, a small label could present a problem for senior patients whose manual dexterity does not allow them to print or write in small spaces.

In an alternative embodiment, the labels 101-120 may be printed onto a substrate (e.g., sheet of paper) that includes perforations, such that the perforations form the borders of each label 101-120. In such a case, the back of each label 101-120 may include an adhesive substance that becomes active only upon the introduction of a liquid to the adhesive, similar to the adhesive used on the back of a postage stamp or envelope flap. To detach a particular label 101-120 in this embodiment, the system user carefully tears out or separates the label 101-120 along its respective perforation lines.

In the preferred embodiment, the labels will be packaged 100 sheets per shrink-wrapped pack for a total of two thousand (2,000) labels per pack. Such packaging will facilitate up to two thousand (2,000) so-called "patient encounters."

In the preferred embodiment, the registration log is a spiral bound book, preferably 8.5 inches wide by 11 inches long (21.6 cm wide by 27.9 cm long), that includes front and back covers and at least one substrate 300 on which to attach the labels 101-120. The front and back surfaces of a preferred front cover 200 of the log are illustrated in FIGS. 2A and 2B. The front and back surfaces of a preferred substrate 300 for attaching the labels are illustrated in FIGS. 3A and 3B.

Referring to FIGS. 2A and 2B, the front or outside surface of the front cover 200 (illustrated in FIG. 2A) preferably includes the words "Practice Name" or a similar indication of the nature of the business for which the log will be used together with a line or two for manually filling out by the practice of business identity. The front cover 200 preferably also includes spaces for manually indicating the duration of time covered by the log (e.g., the date on which the log begins to the date on which the log ends). By including the dates covered by the log, the log may be archived for expedient future reference, if ever necessary.

The back or inside surface of the cover (illustrated in FIG. 2B) preferably includes a full set of preferred and alternate instructions 201-209 describing how the registration method of the present invention is to be used and how to achieve the maximum benefit of the security features that are built into the preferred method. The front and back covers of the log are preferably constructed from commercially-available one hundred ten pound (110#) index paper, although various other constructions may be used without departing from the spirit and scope of the present invention.

Figure 3B:
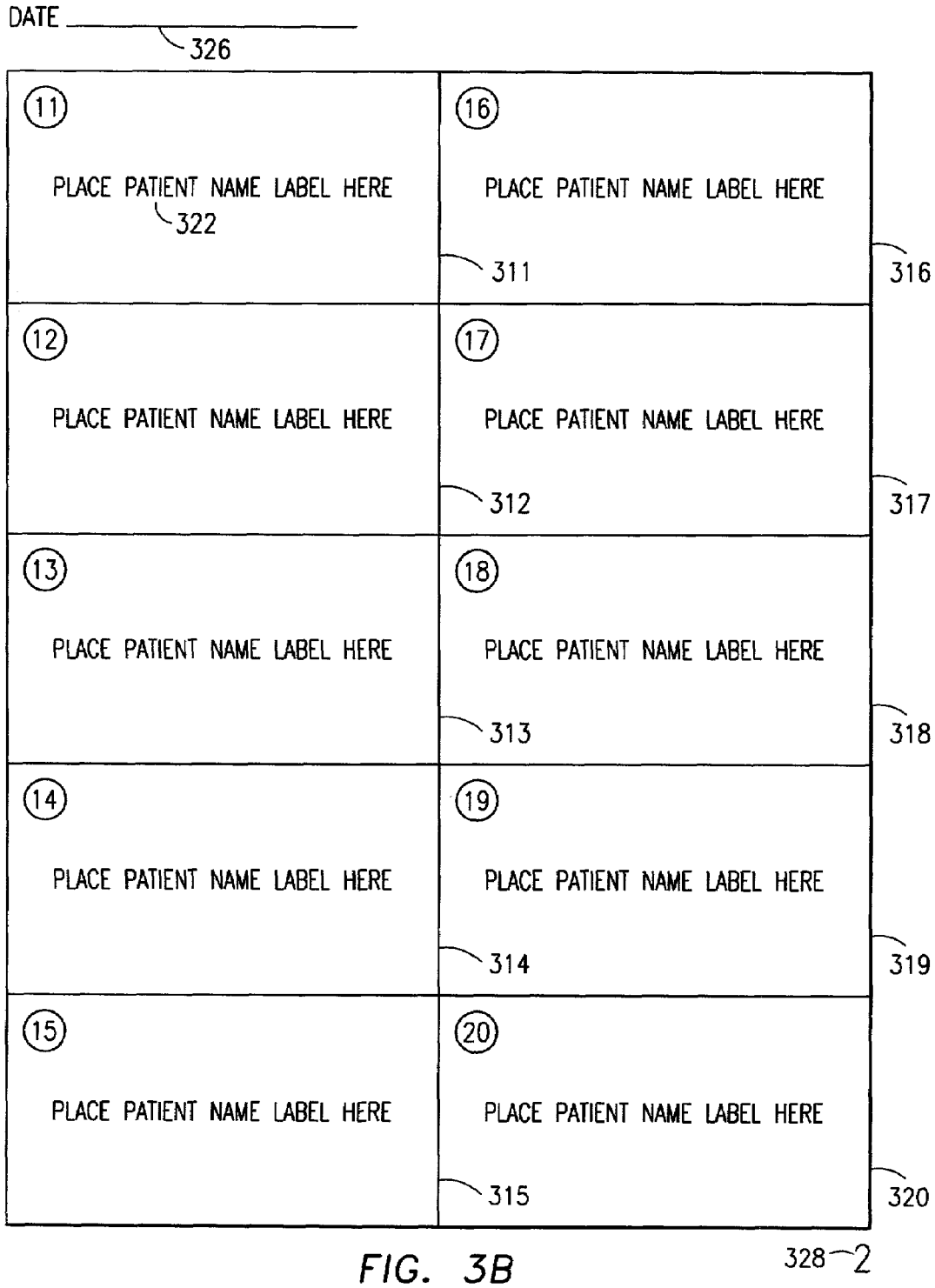

Referring to FIGS. 3A and 3B, each substrate 300 in the log preferably comprises a sheet of commercially-available seventy pound (70#) ivory-colored offset paper and each log preferably includes one hundred (100) sheets or substrates 300. However, the system user or service provider may choose any type of substrate 300 and number of substrates per log to satisfy his or her recording requirements.

Each substrate 300 is preferably printed on its front and back surfaces, in a grid-like format, and includes a plurality of label-retaining spaces 301-320 each preferably measuring approximately 2.0 inches by 3.875 inches (approximately 5.1 cm×9.8 cm). Thus, each label-retaining space 301-320 includes adequate area within which to attach a physically smaller label 101-120. In the preferred embodiment, ten (10) label-retaining spaces 301-310 are sequentially arranged in two columns on the front surface of the substrate 300 as depicted in FIG. 3A and ten (10) spaces are sequentially arranged in two columns on the back surface of the substrate 300 as depicted in FIG. 3B, such that each substrate 300 preferably supports twenty (20) label-retaining spaces 301-320. Thus, in the preferred embodiment, the quantity of label-retaining spaces 301-320 per log substrate 300 coincides identically with the quantity of registration labels 101-120 on a label substrate 100.

Each label-retaining space 301-320 preferably includes text 322, such as "Place Patient Name Label Here" or the like, printed in screened or other selected typeface to instruct the system user where to attach the corresponding label 101-120. Each space 301-320 further preferably includes a unique indicia 324 in the upper left-hand corner to distinguish one space 301-320 from another. The unique indicia 324 of the label-retaining spaces 301-320 correspond to the unique indicia 122 of the labels 101-120 and may comprise a numeral, a letter of the alphabet, an alpha-numeric combination, or any other indicia. The unique indicia 324 of the spaces 301-320 also provide the sequential arrangement of the spaces 301-320 on the log substrate 300.

Both surfaces of the log substrate 300 (e.g., the upper right corner of the front surface and the upper left corner of the back surface) preferably include a designated area 326 (e.g., the word "Date" and an entry line) for a user of the system to manually enter the date or dates on which services were provided to patients or customers whose labels are retained on the substrate 300. The pages or substrates 300 are also preferably numbered in a lower right-hand corner of the substrate 300 or include some other indicia 328 to identify the sequential order of the substrate 300 in the log, particularly when the log includes more than one page or substrate 300 as would typically be the case. By numbering each page in addition to indicating the date(s) of service, the registration system of the present invention is more tamper resistant that are prior art systems that rely only on providing the date of service on each sign-in sheet.

In an alternative embodiment, label-retaining spaces 301-320 may be included on only one surface (e.g., the front surface) of each substrate 300. Alternatively, instead of re-numbering each sheet or substrate 100 of labels 101-120, the label indicia 122 may continue sequentially to a predetermined indicia corresponding to a quantity of sheets of labels (e.g., one hundred) that would normally fit into a spiral bound registration log.

The registration labels 101-120 allow for the patient's original handwriting to be maintained, as opposed to referencing part two or part three of a multi-part carboned or carbonless form. Another benefit of the labels 101-120 of the present invention is that the patient does not have to press hard to make sure their writing is imprinted on another part. Such hard-pressing may be difficult for senior citizens or frail patients.

As noted above, there are twenty (20) label-retaining spaces 301-320 to a page in the registration log and twenty (20) registration labels 101-120 per sheet. Accordingly, since there are preferably one hundred (100) sheets of labels 101-120 in the shrink-wrapped set of labels, and one hundred (100) pages to the preferred registration log (both good for two thousand (2,000) patient encounters), the labels 101-120 and log may preferably be purchased and used by service providers as a set.

As briefly noted above, security features have been incorporated into the registration system of the described embodiments of the present invention. One such feature is the full set of instructions 201-207 which are preferably printed on the inside surface of the cover 200 of the logbook. This feature insures that each user understands how the system works. A second security feature is the provision of corresponding indicia on the labels 101-120 and the label-retaining spaces 301-320 to insure each label 101-120 is placed in the appropriate space 301-320 of the log. Lastly, the pages in the log include sequential indicia 328 (e.g., are numbered from 1-100), rendering the log book tamper resistant.

Figure 4:
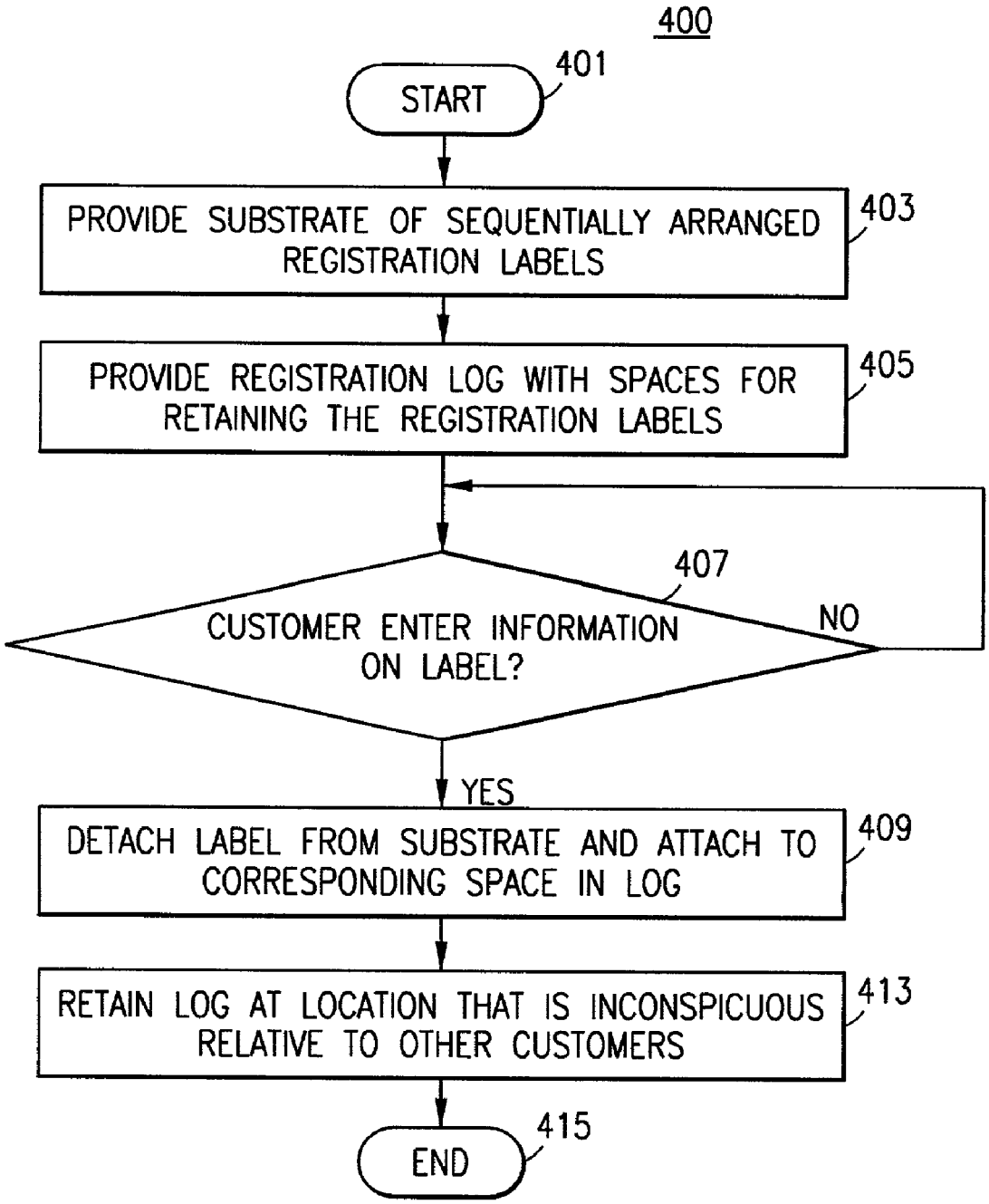
FIG. 4 is a logic flow diagram of steps executed by a service provider to register its customers substantially at the time of service in accordance with a preferred embodiment of the present invention.

FIG. 4 is a logic flow diagram 400 of steps executed by a service provider to register its customers substantially at the time of service in accordance with a preferred embodiment of the present invention. The logic flow begins (401) when the service provider provides (403) a substrate (e.g., sheet) of sequentially arranged registration labels and provides (405) a registration log with spaces for retaining the registration labels. When a customer (e.g., patient) comes to the front desk to sign in or register, the customer might see a clipboard holding a page of registration labels. The customer then takes the clipboard and fills in the requested information (e.g., his or her name, physician's name, arrival time and check whether he or she has had an address or insurance change) on one of the labels. After entering the information, the customer returns the clipboard to the front desk.

Periodically, the service provider's front desk personnel check to determine (407) whether new information has been entered on a registration label. When new information is detected, the front desk personnel detaches (409) the label from the sheet (e.g., peels the label off the sheet in the event that the labels comprise self-adhesive labels or separates the label from the sheet in the event that the sheet includes perforations around the periphery of each label) and attaches the label into a corresponding label-retaining space of the registration log. The service provider personnel must make sure to put the appropriate numbered label in the appropriately numbered space in the log (e.g., label number one goes into space number one, and so on). As described above, each label-retaining space of the log page preferably includes adequate area for attaching the label to the label-retaining space to thereby make the application or attachment of the label easy and stress free.

Once the label is attached to the log sheet, the log is preferably retained (413) at a location (e.g., on or in the desk of the service provider's reception area personnel) that is inconspicuous relative to other customers to maintain the confidentiality of the recently supplied customer information, and the logic flow ends (415). After removing the label and attaching it to the log sheet, the front desk personnel preferably place the clipboard back onto the front desk for the next customer, such that the sheet of registration labels now include one or more blank spaces indicating where labels have been previously removed and put into the log.

As mentioned above, the log is preferably a spiral bound book to occupy less desk space than a three ring binder and remain on the receptionist's desk, away from patient access. In addition, the date is preferably filled in on the upper right of the front surface of the log page and on the upper left of the back surface of the log page to ease locating entries for a specific date.

ALTERNATIVE EMBODIMENTS

The registration log may alternatively be embodied in a three ring binder format. The method for using the log is the same as described above, but some of the security features, such as numbering the pages of the log, would carry an additional cost. Add to that the cost of the binder and the system becomes a more expensive proposition. The labels would be exactly the same as the method described above. The pages to go in the three ring binder would preferably be produced on mylar-reinforced paper stock (i.e., paper in which a mylar strip runs along the eleven inch dimension to add extra support for the three holes that are drilled in the paper). The log sheets would preferably be shrink-wrapped in sets of one hundred (100) to coincide with the packaging of the labels.

Although feasible, the three ring binder approach has several drawbacks. First, with a the three ring binder, it is easy for someone to open the binder, remove a page and close the binder again, thereby compromising the security of the system. Second, the three ring binder takes up twice the desk space of the spiral bound book (which when opened can be folded in half), and storing for archival purposes represents an additional challenge. Third, the front cover of the binder will not have designated areas for identifying the service provider and dates covered by the log (e.g., "Practice Name", "Date From" and "Date To") to be filled out manually by the service provider personnel. The service provider can affix some sort of label to accomplish this, but the label could become separated from the cover and present a retrieval problem. Lastly, the inside of the binder cover would not have the instructions on how the system works, thereby comprising the integrity of the security features. For the above reasons, the spiral bound version of the log is preferred over a three ring binder version.

The present invention comprises a customer registration system and corresponding method of use. With this invention, customers may register or sign-in at the time of service without significantly jeopardizing the confidentiality of the information they provide at the time of registration. In addition, the present invention provides customer confidentiality indiscriminately (e.g., without requiring an appropriate amount of wrist or finger strength to make duplicate carboned or carbonless copies of the customer's handwriting). Further, the present invention includes security features in the registration system to reduce the likelihood that customer information will be misplaced or stolen.

While the foregoing constitute certain preferred and alternative embodiments of the present invention, it is to be understood that the invention is not limited thereto and that, in light of the present disclosure, various other embodiments will be apparent to persons skilled in the art. Accordingly, it is to be recognized that changes can be made without departing from the spirit and scope of the invention as particularly pointed out and distinctly claimed in the appended claims which shall be construed to encompass all legal equivalents thereof

What is claimed is:

1. A customer registration system for improving the protection of the confidentiality of information provided by a customer at the time of registration, said system comprising:

at least one first substrate locatable at a first location;

a plurality of registration labels detachably adhered to said first substrate, each of said labels having one of a series of first indicia identifying the position of each of said labels in an uninterrupted sequence, each of said labels further having at least one field within which the information is to be entered in writing by the customer, said first location being a location sufficiently accessible to the customer to permit the customer to view said labels detachably adhered to said first substrate and to enter the information in said field of one of said labels while said one of said labels remains detachably adhered to said first substrate, and a registration log having at least one second substrate, said second substrate having a plurality of label-retaining spaces and a series of second indicia, said second indicia corresponding to said first indicia to associate each one of said spaces with a respective corresponding one of said labels according to said sequence, each said one of said spaces including an area to which said respective corresponding one of said labels may be adhered after the information has been entered in writing in said field by the customer and said corresponding one of said labels has been detached from said first substrate so that said labels adhered to said second substrate provide an original record of said writing, said second substrate being locatable at a second location at a time when said first substrate is located at said first location, said second location being a location at which the entered information on any said labels adhered to said second substrate is out of view of the customer in order to protect the confidentiality of the information.

2. The customer registration system of claim 1, wherein said registration log includes more than one said second substrate and each said second substrate further includes third indicia to identify a sequential order of said second substrates in said registration log.

3. The customer registration system of claim 1, wherein said second substrate further includes a designated area for a user of the system to enter a date on which services were provided to the customer.

4. The customer registration system of claim 1, further comprising text associated with said label-retaining spaces, said text including instructions to attach said labels in said label-retaining spaces.

5. The customer registration system of claim 1, wherein said plurality of registration labels are detachably adhered to respective ones of a plurality of said first substrates, and wherein said registration log includes a plurality of said second substrates, each of said second substrates including a plurality of label-retaining spaces arranged sequentially thereon for retaining at least some of said labels after entry of information on said labels by customers and detachment thereof from said first substrates.

6. The customer registration system of claim 1, wherein said plurality of said labels are arranged in sets, each of said sets having a given said sequence of said first indicia and wherein at least two of said sets have the same said sequence of said first indicia.

7. The customer registration system of claim 1, wherein said first substrate includes a first surface and a mutually opposed second surface and wherein said plurality of labels are adhered only to said first surface.

8. The customer registration system of claim 1, wherein said second substrate includes a first surface and a mutually opposed second surface and wherein said plurality of label-retaining spaces are disposed on both said first surface and said second surface.

9. The customer registration system of claim 1, wherein said first indicia comprises at least one of a numeral and a letter of the alphabet.

10. The customer registration system of claim 1, wherein said second indicia of said label-retaining space comprises at least one of a numeral and a letter of the alphabet.

11. The customer registration system of claim 1, wherein said registration log comprises a spiral bound book.

* * * * *